United States Patent [19]

Andersson et al.

[11] 4,240,482

[45] Dec. 23, 1980

[54] BAG-LIKE LIQUID CONTAINERS, ESPECIALLY FOR MEDICAL TREATMENT

[75] Inventors: Karl G. B Andersson; Ulla I. Forsberg; Knut I. Larka, all of Halmstad, Sweden

[73] Assignee: Duni Bila AB, Sweden

[21] Appl. No.: 21,065

[22] Filed: Mar. 16, 1979

[30] Foreign Application Priority Data

Mar. 17, 1978 [SE] Sweden ..... 7803093

[51] Int. Cl.[3] ..... B65D 33/38

[52] U.S. Cl. ..... 150/8; 128/DIG. 24; 222/566

[58] Field of Search ..... 150/8; 222/107, 566, 222/573; 128/DIG. 24

[56] References Cited

U.S. PATENT DOCUMENTS

| | | | |
|---|---|---|---|
| 2,713,369 | 7/1955 | Strahm | 222/107 UX |
| 3,105,613 | 10/1963 | Barton | 222/107 X |
| 3,259,920 | 7/1966 | Voller | 128/DIG. 24 |
| 3,471,064 | 10/1969 | Micallef | 222/211 |
| 3,690,524 | 9/1972 | Haberhauer | 150/8 X |
| 3,963,026 | 6/1976 | Herb | 150/8 X |
| 4,023,607 | 5/1977 | Jensen | 150/1 |
| 4,126,167 | 11/1978 | Smith | 150/8 |

*Primary Examiner*—Donald F. Norton

*Attorney, Agent, or Firm*—Ostrolenk Faber Gerb & Soffen

[57] ABSTRACT

A bag-like liquid container especially intended for medical use is formed from flexible material and includes at least one closable spout for filling or emptying the container, having its center line substantially in the plane of the flat container, the spout being provided with a flange formed integral therewith, said flange being weldably unitable to the container material for providing a completely impervious attachment of the spout to the container as well as a separation of the sides of the container so that liquid flowing into and out of the container is always guaranteed a free passage.

3 Claims, 3 Drawing Figures

BAG-LIKE LIQUID CONTAINERS, ESPECIALLY FOR MEDICAL TREATMENT

Figure 1:
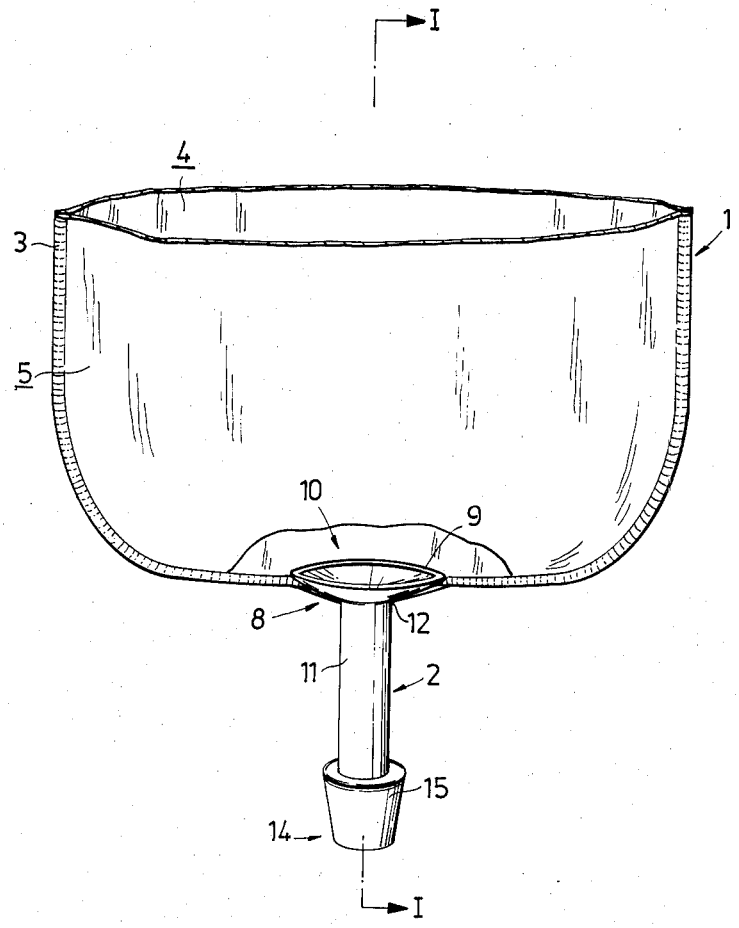

The present invention relates to improvements in bag-like liquid containers, especially intended for medical treatment, from flexible material consisting of two flat plastic films welded together at the edges, or a plastic film folded double and welded together, and including at least one closable spout intended for filling or emptying the container, having its centre line substantially in the plane of the flat container.

Such bag-like plastic packs or containers are used in several different areas in medical care, e.g. for administering nutrients or blood replacing agent intravenously, for enema, and not least in the field of handling urine. In said fields of use, there is the problem of collecting, storing or tapping off liquids. These plastic containers have previously been provided with inlet and outlet pipes or spouts fastened between the plastic layers forming the container itself, in such a way that the respective plastic film layer covers a certain distance along the pipe and surrounds half its circumference for coming into contact and being heat-sealed against the opposing plastic film layer. The layers have here been allowed to form two opposing flanges along the pipe with a width of approximately one pipe thickness, and over a distance along the pipe of about three times the pipe thickness. These traditional attachments of filling or tapping-off pipes have been found difficult to make completely impervious to liquid, which has caused great problems. Such a leakage risk has, inter alia, occurred by the cylindrical pipe not being able to be firmly attached to the container or bag by a union between materials, other than by using a material dissolving liquid, e.g. cyclohexanone for polyvinyl chloride. Longitudinal channels can occur between the plastic film layer and the pipe, as well as pores caused by an overdose of said cyclohexanone, for example, on the thin plastic film layers. In the cases where solvent or glue is not used in combination with welding the sides of the bag snugly on either side on the pipe, for attaching pipe to bag, shrinkage or pressed joints have been used, but in such joints the imperviousness has been dependent on how well the closing forces have been able to indure, even for a long storage time.

The object of the present invention is to avoid the disadvantages to be found in these types of pack or liquid container with spouts, and to provide a device which is essentially distinguished in that the spout is provided at one end with a flange integral therewith, which is weldably unifiable with the container material for providing, apart from a completely impervious attachment of the spout to the container, the separation of the sides of the container such that a free passage for liquid flowing into or out of the container is always guaranteed.

By means of the invention, there is now obtained a device which meets the purpose excellently, but is simple and cheap in its construction at the same time. By the spout, via its flange, being welded and joined to the bag material to form a single unit, an absolutely leak-free attachment of the spout is obtained. Furthermore, the flange provides separation of the side walls of the liquid container, which results in that a free passage for liquid intended to flow into or out of the container can always be guaranteed.

Figure 2:
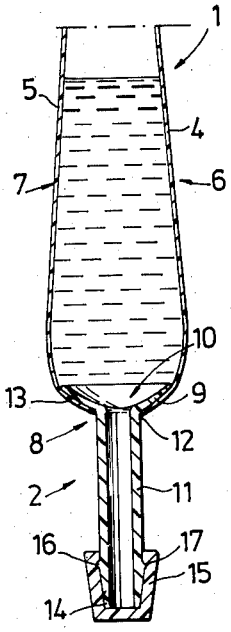
Figure 3:
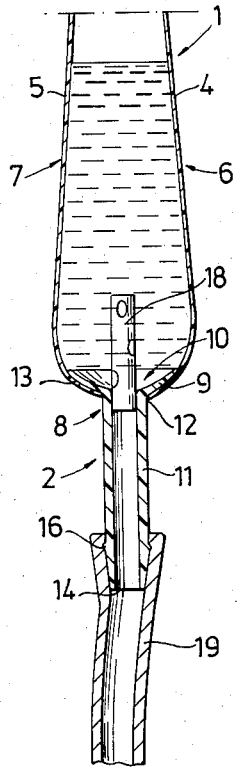

The invention will now be described in detail while referring to the attached drawing, in which FIG. 1 illustrates in perspective and partial section an embodiment selected as an example of a discharge spout, FIG. 2 is a section along the line I—I in the liquid container shown in FIG. 1, and FIG. 3 is a section similar to the one in FIG. 2, but where the spout is provided with a length of draining pipe and connected to a discharge tube.

The liquid container 1, shown as an example, is provided with a closable spout 2, in accordance with the present invention, for emptying the container 1. The container 1 consists of two flat plastic films 4 and 5 welded together at the edges 3, said films forming the sides or walls 6 and 7 of the container. At one end 8, the spout 2 is integrally formed with a flange 9, which both surrounds and starts from an aperture, or more precisely, an inlet opening 10 at the flanged end 8 of the spout 2.

The spout 2 consists of a flexible tube 11 extending through an opening 12 arranged in the container 1, said opening having a diameter approximately conforming to that of the tube 11. The flange 9 formed at the end 8 of the tube 11 engages against a surface 13 contiguous to the pipe 11, against the inside of the container 1, which is advantageous for manufacture, while a qualitatively very secure attachment between the flange 9 and the sides 6 and 7 of the container is obtained. It is naturally also possible to fix the flange 9 with the associated spout 2 onto the outside of the container 1, whereby the manufacturing process is simplified, but a qualitatively somewhat inferior attachment of the flange 9 to the sides 6 and 7 of the container is obtained. Both spout 2 with associated flange 9 and the liquid container 1 are manufactured from such materials which are weldably unitable with each other, e.g. polyvinyl chloride. The flange 9 suitably consists of a collar formed at the end 8 of the spout and extending round the inlet opening 10 of the tube 11, said collar being dimensioned in relation to its own stiffness and that of the bag material concerning its development form, e.g. curvature and ovality, and in radial section thickness such as to give good welding conditions between collar and container films 4,5 for imperviousness and strength, as well as a judicious spread of the container sides 6,7 to ensure drainage, while a "discreet bag thickness" is obtained,-the container should not bulge out under the clothes of someone wearing it. The flange 9 suitably has the form of a bowl, the bottom portion of which is the inlet opening 10 of the spout 2. In one embodiment, the flange 9 can be completely gyrationally symmetric, which gives a simple injection moulding tool. With special formation of the flange, the bottom of the bag can be given any desired form.

At its other, free end 14, the spout is closable by means of a flexible cap 15, for example, which can be pushed onto the tube 11. The cap 15 is kept onto the pipe 11 by means of a bead 16, formed on the tube 11 close to its end 14, said bead 16 co-acting with a complementary groove 17 formed in the cap 15.

In certain cases where further separation of the side walls 6 and 7 of the container 1 is desired, e.g. for persons confined to bed, a length of pipe 18 (FIG. 3) provided with holes can be inserted in the inlet opening 10 of the spout 2, and a short distance into the tube 11. The length of pipe 18 has a diameter large enough for retaining it by friction in the tube 11. The end 14 of the spout 2 is here connected to a discharge tube 19 pushed over the bead 16 on the pipe 11.

We claim:

1. A bag-like liquid container especially intended for medical purposes welded from at least two layers of flexible flat plastic film joined at their edges to form a bag that is flat when empty, the edges of said layers of plastic film being left unjoined at one point to define an aperture in the container, and at least one closable cylindrical spout extending through said aperture in said container and intended for filling or emptying the container, said spout having its center line substantially in the plane of the container when said container is in a flat condition, said spout provided with a bowl-shaped flange formed integral with said spout, the surface of said flange merging with the outside of said spout engaging against and welded to the interior face of said layers of plastic film so as to provide a completely impervious attachment of the spout to the container as well as a separation of the sides of the container such that the liquid flowing into and out of the container is always guaranteed a free passage, the radial cross-sectional thickness of said bowl-shaped flange diminishing toward the outer periphery of said flange.

2. A device as claimed in claim 1, characterized in that the spout consists of a tube of flexible material.

3. A device as claimed in claim 1, wherein the spout has an opening for liquid to pass through and wherein the device is characterized in that for further separation of the side walls of the container, there is a holed length of pipe fixedly arranged in the opening at the flange end of the spout inside the container.

* * * * *